United States Patent [19]

Farrington et al.

[11] Patent Number: 4,654,018

[45] Date of Patent: Mar. 31, 1987

[54] FIGURE TOY WITH LAUNCHING MECHANISM FOR CONCELED FLYING ELEMENT

[75] Inventors: Richard I. Farrington, New Britain; Jeffrey W. Lawrence, West Hartford, both of Conn.

[73] Assignee: Coleco Industries, Inc., West Hartford, Conn.

[21] Appl. No.: 826,854

[22] Filed: Feb. 6, 1986

[51] Int. Cl.[4] ..... A63H 27/12

[52] U.S. Cl. ..... 446/38; 446/308; 446/310; 446/327; 446/330

[58] Field of Search ..... 446/38–45, 446/309, 308, 435, 259, 263, 310, 327, 330; 124/26, 79; 273/357, 364, 405; 272/27 N

[56] References Cited

U.S. PATENT DOCUMENTS 506,619 10/1893 Bailey .
2,611,997 9/1952 Solloway et al. .
2,651,881 9/1953 Glass et al. .
2,731,767 1/1956 Holt .
3,151,866 10/1964 Glass et al. ..... 446/39 X
3,269,055 8/1966 Gordon ..... 446/259 X
3,473,256 10/1969 Tyler .
3,572,715 3/1971 Ramirez ..... 446/310 X
3,688,435 9/1972 Sapkus et al. .
4,180,939 1/1980 Matsushiro .
4,512,748 4/1985 Matsumoto et al. ..... 446/330 X

*Primary Examiner*—Mickey Yu

[57] ABSTRACT

A creature figure toy includes a launching device for a flying object. The object is seated within an enclosure formed by wings simulated on the body of the device, in which position high-speed rotation can be imparted to it. When the operator wishes to release the object, the actuating lever is moved to a stroke limit position, whereupon the enclosing wings spring open to permit exit of the object.

17 Claims, 11 Drawing Figures

FIGURE TOY WITH LAUNCHING MECHANISM FOR CONCELED FLYING ELEMENT

BACKGROUND OF THE INVENTION

An ongoing demand exists for action toys having novel features. It is of course important that any such toy be effective in its appearance and operation, while also being durable and relatively facile and inexpensive to manufacture. The prior art discloses numerous forms of action toys in which various parts can be moved in different ways, and which achieve a wide diversity of effects; typical are the following U.S. patents:

The toy money bank of Bailey U.S. Pat. No. 506,619 has a spring-loaded figure which pivots to an upright position when the catch of a cover is released.

Holt U.S. Pat. No. 2,731,767 discloses a device wherein an electric motor is used to rotate the propeller of a helicopter toy, which is held in place on the platform of the launching unit by a latch arrangement.

Tyler U.S. Pat. No. 3,473,256 shows a mechanical launching mechanism for a flying top, which utilizes a reduction gear train.

In Sapkus et al U.S. Pat. No. 3,688,435, housing parts of the toy open to receive an extended member, which is pivotably attached to one of them.

In Matsushiro U.S. Pat. No. 4,180,939, a crank mechanism is employed to impart rotation to the blade of toy helicopter, which is held in place by a slide bar until release is to be effected.

A so-called "wrist rocket" toy comprised of a flying rotor enclosed within a covered case, which is designed to be worn on the wrist, has been commercially available from Illco Toy Company. To operate the device the cover is first pivoted to an open position, and a lever is then pulled to effect spinning of the rotor through a gear train, thus causing the rotor to fly from the actuating mechanism.

It is an object of the present invention to provide a novel device for launching a flying object, which permits the operator to control the time of release, and a novel toy that employs such a device.

A more specific object is to provide such a device and toy wherein release of the flying object is effected by the actuating means for the spinning mechanism.

Another specific object of the invention is to provide such a device and toy in the form of a winged creature figure, wherein the wings enclose the flying object and automatically open to release it when the operator chooses to do so.

Additional objects of the invention are to provide such a device and toy which are effective in their appearance and utility, are durable, and are relatively facile and inexpensive to manufacture.

SUMMARY OF THE INVENTION

It has now been found that certain of the foregoing and related objects of the invention are attained by the provision of a device for launching a flying object, comprising a body having a receptacle portion for seating a separate object that is capable of flight when spun, and closure means mounted on the body for movement between a closed position, over the receptacle portion, and an open position displaced therefrom. The closure means cooperates with the body to provide an enclosure within which the object can spin, and means is provided for releasably engaging the closure means in closed position. A spinning mechanism within the body includes an element that is disposed for releasably engaging the object within the receptacle portion to impart rotation thereto, and manual actuating means, capable of stroking movement, serves to drive the spinning mechanism; it also effects release of the engaging means at a certain point during the stroke thereof. Thus, the actuating means can first impart rotation to the flying object disposed within the enclosure of the body, and can then effect release of the engaging means to displace the closure means and thereby permit the spinning object to fly out of the receptacle portion and away from the device.

In the preferred embodiments, the actuating means will comprise a lever pivotably mounted upon the body, with the point of release of the closure means occurring substantially at a limit of the lever stroke. Most desirably, the actuating means will have a power stroke in one direction and a recovery stroke in the opposite direction, with the spinning mechanism including means for effectively disconnecting the actuating means from the object-engaging element in the "opposite" direction, to thereby provide the recovery stroke. Specifically, the spinning mechanism will advantageously comprise a gear train including an idler gear which is mounted for shifting movement into and out of operative engagement, depending upon the direction of force applied to it.

The closure means will advantageously comprise a pair of door members which are pivotably mounted upon the body and which have associated means biasing them toward their open positions. Suitable engaging means for the door members will comprise a link mounted for shifting movement within the body and operatively connected to the actuating lever, with one of the doors and the link having cooperating means thereon for latching the former in its closed position.

In especially desirable embodiments, the actuating lever will have a path defined in or on it, with a contact surface at (or effectively defining) one end. The link will have an element which extends into the defined path, and which is disposed to pass freely therealong and to contact the end surface at the stroke limit. Such contact will cause shifting of the link to disengage the cooperating latching means and to thereby establish the point of release. The door members may have interengaging means thereon to enable one of them to hold the other in closed position, with the "one" door member having a latching element thereon comprising the engaging means.

In more specific embodiments, the body of the launching device may be in the form of a creature with the door members being formed to resemble wings, and the flying object may take the form of a flying insect. The device may additionally include a plurality of leg-simulating appendages on the body, one of which comprises a component of the actuating lever, and two others being made of a resiliently deflectable material. The latter may have finger-engaging elements thereon, and the device may additionally include a rigid holder attached to the body and adapted to receive two fingers for holding the device. The deflectable appendages will be positioned with respect to the holder so as to permit the user to engage and move them with the fingers that are received by the holder.

Other objects of the invention are attained by the provision of a flying object toy, which comprises an object that is capable of flight when spun, and a device for launching the object. The launching device embodies features hereinabove set forth.

DETAILED DESCRIPTION OF THE ILLUSTRATED EMBODIMENT

Turning now in detail to the appended drawings, therein illustrated is a toy embodying the present invention, which consists of a launching unit, in the form of a winged creature, and a flying object of insect-like appearance, the latter being generally designated by the numeral 10. It will be understood that the science fiction motif for the figures depicted is not to be taken as limiting; thus, the particular character and forms of toys and components embodying the invention can deviate widely from the embodiment shown.

Figure 3:
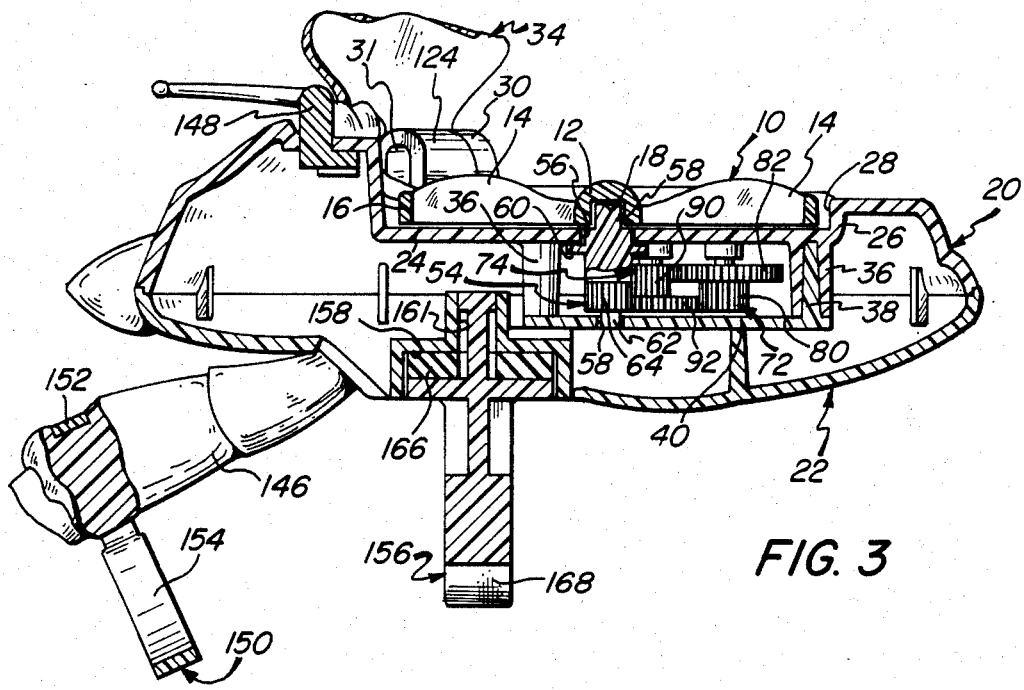
FIG. 3 is a fragmentary sectional view of the toy of the previous Figures, taken along lines 3—3 of FIG. 2.

The flying object illustrated consists of a body portion 12 with four attached wing-like elements 14, which are circumscribed by a ring element 16 for strength and stability. The wing elements 14 extend radially, at substantially equidistantly spaced angular positions on the body portion 12, and they are tilted in the plane of rotation to afford an airfoil effect; that is, the spinning object 10 will function like a propeller. As seen in FIG. 3, the body portion 12 has a recess 18 formed into its lower surface, which is of straight-sided, noncircular cross section for engagement with a mating driving element to enable spinning motion to be imparted to it, as will be described below.

The launching unit of the toy consists of a substantially hollow body formed as upper and lower sections, generally designated respectively by the numerals 20, 22, secured together by appropriate means, such as with screws engaged in suitable formations 23. The upper section has a shallow circular depression formed therein by a bottom wall 24 and a circumferential sidewall 26, which provides a receptacle 28 for rotatably seating the flying object 10. Shoulder formations 30, 31 are disposed forwardly on the upper body section 20 to the opposite sides of the receptacle 28, and serve to pivotably mount the wing-simulating door members, generally designated by the numerals 32, 34; they, and the mounting arrangement, will also be more fully described hereinbelow. Three hollow posts 36 depend from the upper body section 20 and receive pins 38, which project from a cover plate 40 and serve to secure it in assembly.

Figure 5:
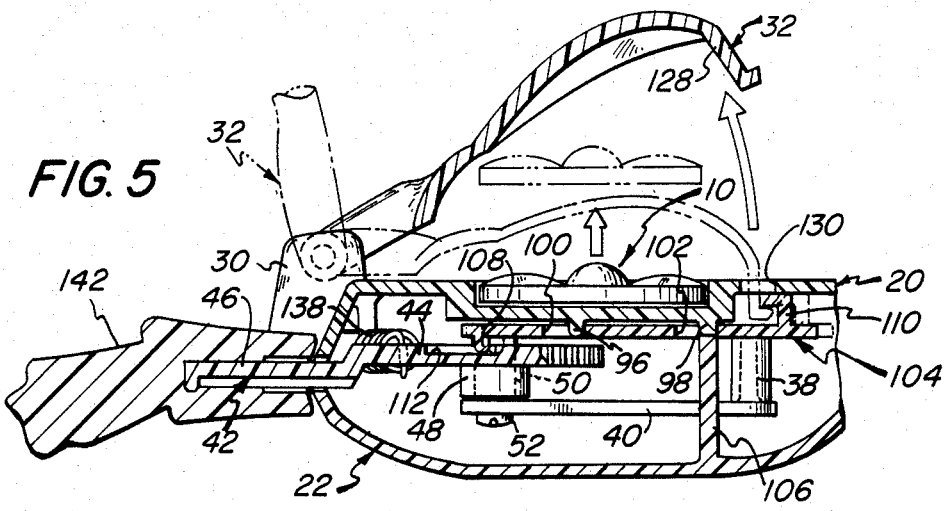
FIG. 5 is a fragmentary sectional view of the toy, taken along line 5—5 of FIG. 4, showing the enclosing wing members in their closed and fully open positions (phantom line), and in an intermediate position (full line) therebetween, and showing (in full and phantom line, respectively) the flying object disposed within and exiting from the launching unit body.
Figure 6:
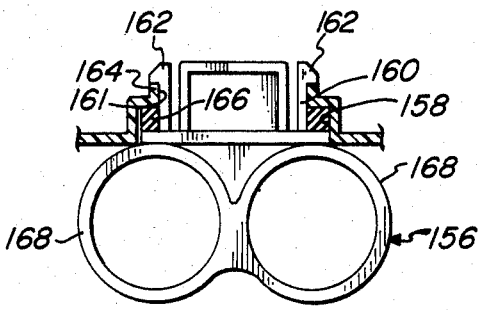
FIG. 6 is a fragmentary rear elevational view, taken along line 6—6 of FIG. 4, showing the holding means for the launching device and the adjacent wall portion thereof.
Figure 7:
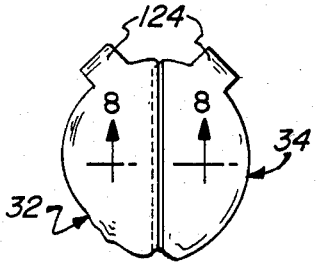
FIG. 7 is a plan view of the enclosure-forming wing members, shown in their interengaged closed position and drawn to a scale reduced from that of the previous Figures.
Figure 8:
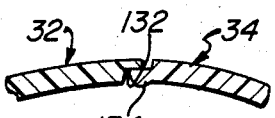
FIG. 8 is a sectional view of the wing members taken along line 8—8 of FIG. 7 and drawn to an enlarged scale.
Figure 9:
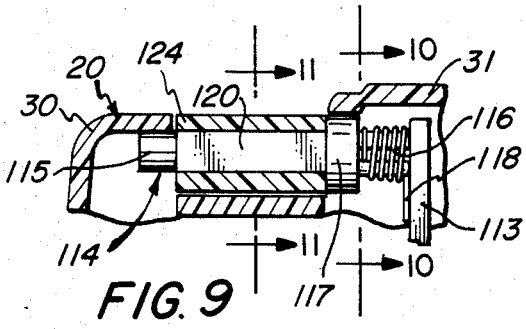
FIG. 9 is a fragmentary sectional view of the wing member mounting subassembly and adjacent structure, taken along line 9—9 of FIG. 2 and drawn to a scale enlarged therefrom.
Figure 11:
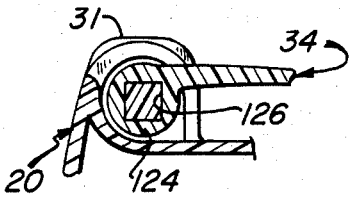
FIG. 11 is a further fragmentary view thereof, taken along line 11—11 of FIG. 9.
Figure 10:
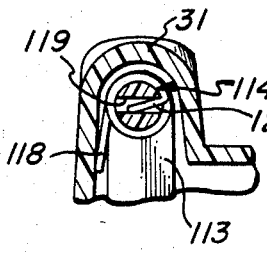
FIG. 10 is a fragmentary sectional view of the same subassembly and structure, taken along line 10—10 of FIG. 9.

The actuating mechanism for imparting spinning action to the flying object 10 is contained substantially within the space between the wall portion 24 and the plate 40. It comprises an actuating lever, generally designated by the numeral 42, which has a semicircular head portion 44 and a radially extending operating arm 46. As seen in FIG. 5, the lever 42 has an aperture (unnumbered) surrounded by collar element 48 on the head portion 44, through which extends the hollow mounting post 50 which depends from the wall portion 24; a screw 52 secures the assembly as well as the coverplate 40.

A drive lug, generally designated by the numeral 54, is rotatably mounted between the wall portion 24 and the coverplate 40, both of which are formed with suitable apertures 56, 58, respectively, for that purpose. The protruding end portion 58 of the drive lug 54 is of straight-sided, noncircular (e.g., square) cross-sectional configuration conforming to that of the recess 18 formed into the flying object 10, to permit them to be interengaged against relative rotation; it will be appreciated that the object 10 is freely slidable on the element 58, permitting it to readily be disengaged outwardly of the body in an axial (normally upward) direction. An annular shoulder is provided by the circumferential collar element 60 adjacent the cylindrical bearing surface by which the lug is rotatably engaged within the wall opening 56, and a stub axle 62 extends from the opposite end to rotatably support the lug within the opening 58 in the plate 40; a gear portion 64 is disposed adjacent the axle 62.

Figure 4:
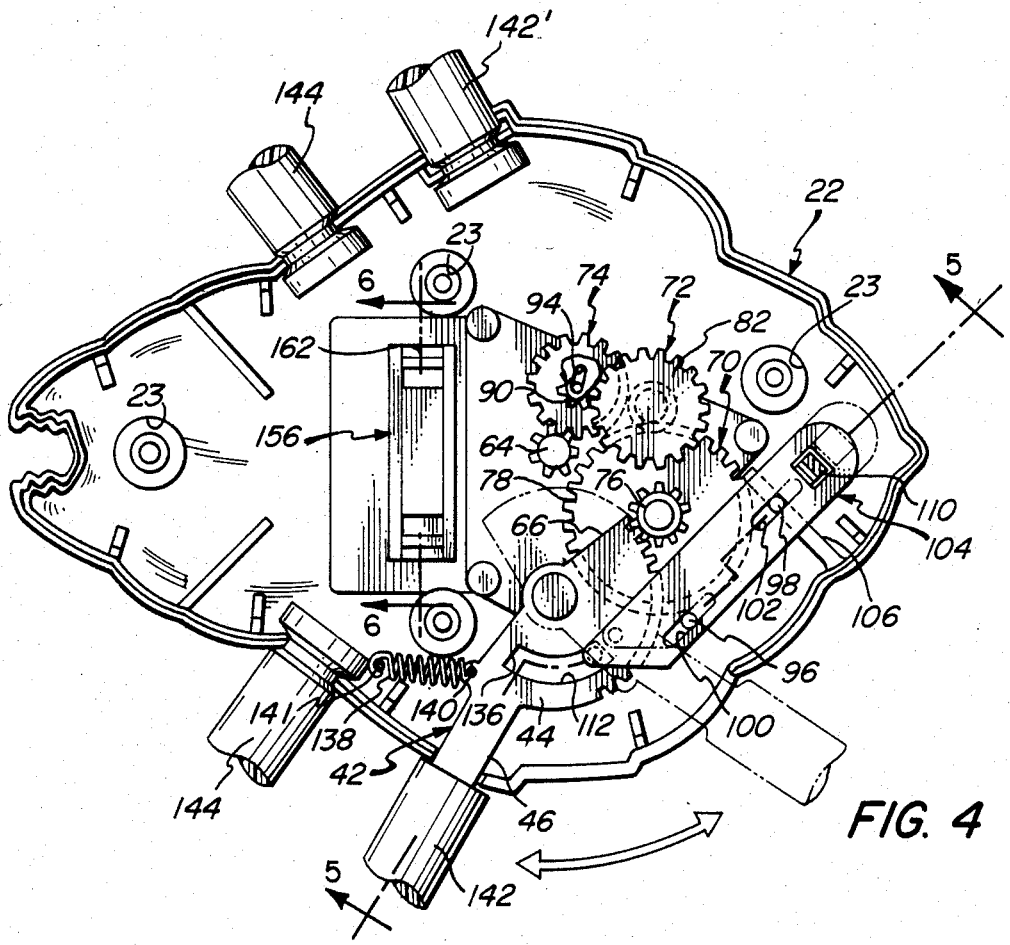
FIG. 4 is a plan view of the launching unit with the top body section removed and with portions shown in section, the stroke limit positions of the actuating lever being shown in full and phantom line.

The arcuate marginal portion 66 of the operating lever 42 is formed with an array of teeth, by which power generated by the lever is delivered. Transmission occurs through a train of three intermeshing compound gears, generally designated by the numerals 70, 72 and 74, as best seen in FIGS. 3 and 4. The upper (smaller) portion 76 of the gear 70 is in meshing engagement with the teeth of the actuating lever marginal portion 66, and its lower portion 78 engages the smaller portion 80 of compound gear 72. The upper portion 82 thereof in turn engages the portion 90 of the gear 74, the larger portion 92 of which meshes with the gear portion 64 on the engagement lug 54. Thus, and as a result of the gear ratios of the gear train components, pivoting of the actuating lever 42 rotates the lug 54 at a high rate of speed.

It will be noted that the compound gear 74 is mounted within short slots 94 formed through the wall portion 24 and the plate 40 (the slot in the plate is not visible, however). This allows it to slip out of engagement with the gear portion 64 when the adjacent compound gear 72 is rotated in a clockwise direction, as seen in FIG. 4; the reason for incorporating this feature will be discussed more fully below.

Two small pins 96, 98 (best seen in FIG. 5) depend from the wall portion 24, and are received within longitudinally extending slots 100, 102 of link or slide member 104, thereby slidably mounting it within the body of the launching unit; underlying support is provided by the rib 106. The slide member has a depending pin 108 adjacent one end and an upstanding catch element 110 adjacent the other. The pin 108 is slidably engaged within an arcuate groove or channel 112 formed into the upper surface of the head portion 44 of the actuating lever 42.

Figure 1:
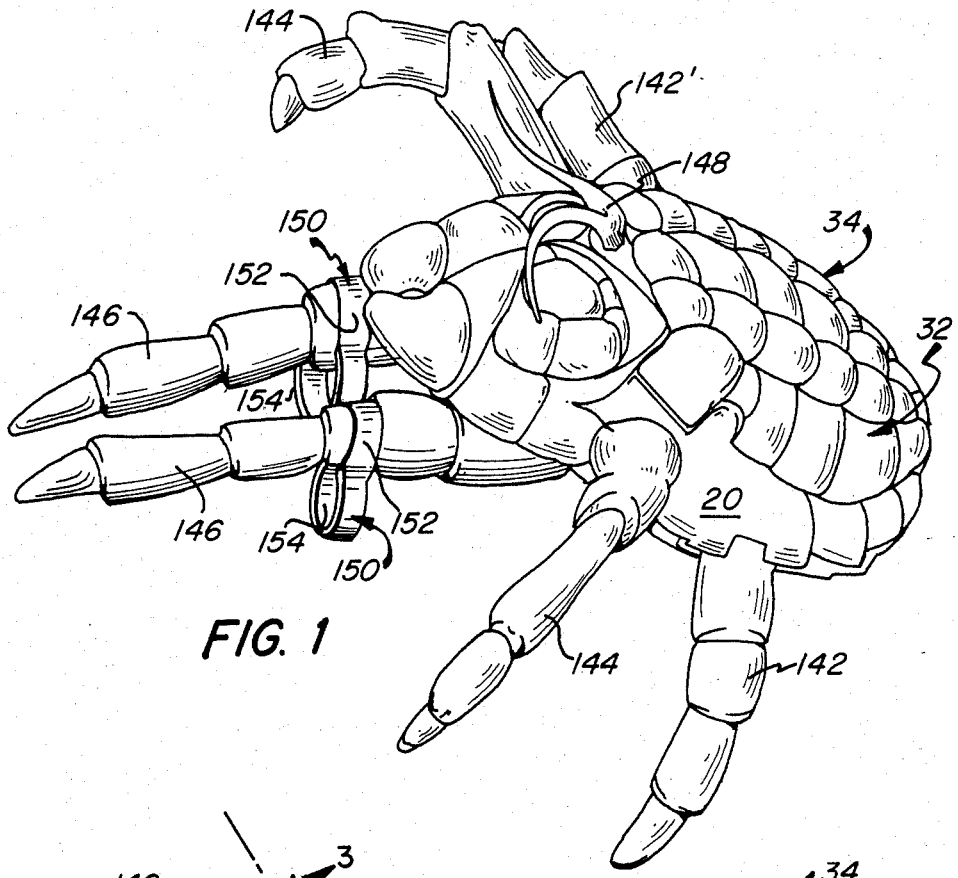
FIG. 1 is a perspective view of a flying object toy which utilizes a launching device, in the form of a winged creature figure, embodying the present invention.
Figure 2:
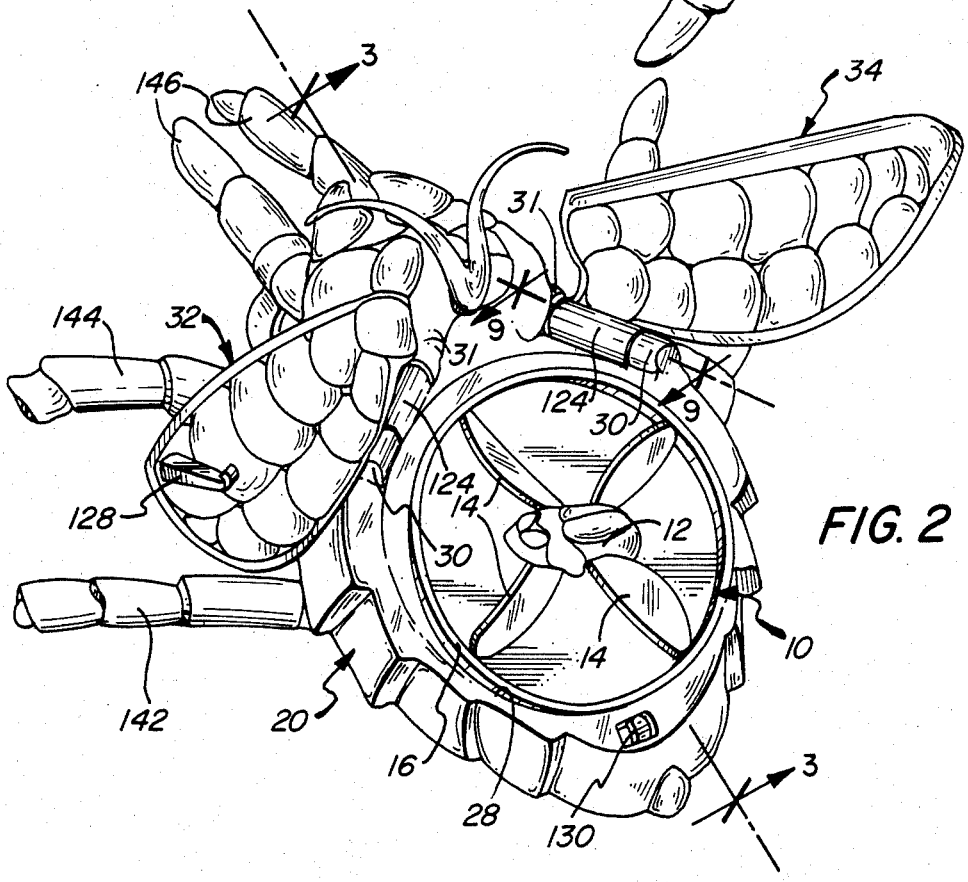
FIG. 2 is a fragmentary perspective view thereof, showing the simulated wings of the launching device in open position and showing the flying object seated within the receptacle portion thereof.

The two shoulder formations 30, 31 on either side of the receptacle portion 28 support wing mounting shafts, generally designated by the numeral 114, which extend thereacross. The shafts 114 are pivotably mounted by a cylindrical portion 115 at one end, which bears upon the curved inner surface of the formation 30, and by a collar portion 117 adjacent the opposite end, which bears upon the surface of the portion 31; the end of the shaft butts against the internal rib 113. Each shaft carries a torsion spring 116 adjacent its collar portion 117, the spring having one end portion 121 affixed within the slot 119 of the shaft 114 and having its opposite end portion 118 bearing upon adjacent housing structure to generate biasing force thereupon in the opening direction. Fixed upon the central section 120 of each shaft 114, which is of square cross section, is the generally cylindrical mounting portion 122 of one of the wing-simulating door members 32, 34, the portions 122 having passages 124 therethrough which are also of square cross section to correspond to the shaft portions 120. The two door members are thereby mounted upon the upper body section 20, and are biased toward the open positions thereof shown in FIGS. 2, 3 and 5.

The door member 32 additionally has a depending hook element 128 thereon, which is dimensioned and configured to pass through the aperture 130 formed in the upper body section 20 and into engagement with the catch element 110 formed on the slide member 104. Thus, the hook and catch elements serve to latch the door member 32 in its closed position over the receptacle portion 28. The same door member also has a groove 132 formed along the underside of its inner margin, which overlaps a tongue element 134 along the adjacent margin of the other door member 34 when the door members are in closed position. As a result of this interengagement, the one hook element 128 serves to secure both members 32, 34 over the receptacle portion of the body.

Operation of the unit to launch the flying object 10 will be readily understood. The object is of course placed into the receptacle portion 28 with the element 58 of the drive lug 54 engaged within the recess 18 of its body portion 12. Force upon the actuating lever 42, to move it from the full line position to the phantom line position, as shown in FIG. 4, will transmit power from its toothed marginal portion 66 to the driving lug 54 through the train comprised of compound gears 70, 72, 74, to thereby spin the object 10 at a high rate of speed. Despite the development of sufficient lifting forces in the spinning airfoil, flight of the object 10 is prevented by the closed door members 32, 34. At such time as the operator chooses to effect release, however, the lever 42 will be brought to the limit of its power stroke, causing the surface 136 at the end of the groove 112 to contact the depending pin element 108 of the slide 104, thereby effecting disengagement of the catch element 110 from the hook element 128. This will allow the door members to spring to their open positions (shown in FIG. 2), in turn permitting the spinning object 10 to fly away from the launching device.

As indicated previously, the compound gear 74 is mounted to slip out of effective engagement. Specifically, when the lever 42 is moved from the phantom line to the full line position of FIG. 4, clockwise rotation of gear 72 will shift gear 74 away from the driving lug gear portion 64. Consequently, the lever can be repeatedly stroked, or pumped, to rotate the object 10 at high speed before the link 104 is actuated to unlock the door members and effect its release. This will of course enable flight time and distance to be maximized.

A coil spring 138 has one end secured through an aperture formed in a small knuckle 140 on the lever head portion 44, and has its opposite end attached to a post 141 which depends from the upper section wall portion 24. The spring 138 thus serves to return the lever 42 to its forward (full line in FIG. 4) position and, in so doing, also shifts the locking slide 104 to its position of engagement with the door member hook element 128 through contact of the pin element 108 against the wall surface (unnumbered) at the opposite end of the slot 112.

The launching unit has six appendages 142, 142', 144 and 146, and an antenna-simulating piece 148 mounted through the upper wall of the section 20, to enhance its creature-like appearance. The leg members 142' and 144 are fixed in position within the lower body section 22; the appendage 142 is however attached to the arm portion 46 of the actuating lever 42, thereby disguising its utilitarian function and contributing further to the unique appearance of the launching unit.

The forward two appendages 146 are both formed of a resiliently deflectable material, such as a 50 Durometer value polyvinyl chloride resin. They have mounted upon them ring pieces 150, each of which has a relatively small circular portion 152 engaging the associated appendage, and a relatively large circular portion 154 dimensioned to receive the tip of a finger. A narrow channel interconnects the two portions, and permits facile mounting by inserting the appendage into the larger portion and then slipping it through the channel to the smaller one.

In addition, a rigid holder, generally designated by the numeral 156, is secured within a recess 158 formed into the lower body section 22, with a resilient element 166 interposed therebetween. The holder is formed with a pair of deflectable prongs 160, which have outwardly directed barb components 162 at their free ends to catch over the edge of the wall structure 164 defining the body opening 161 in which the holder is thereby secured. As will be apparent, the launching device is supported on the operator's hand by inserting two of his fingers (normally the first two) through the openings of the side-by-side ring portions 168 thereof, with the tips of the same fingers conveniently being engaged within the relatively large sections of the ring pieces 150, simultaneously enabling stable support of the device and movement of the forward appendages 146 for animation of the figure.

Materials of construction used for the several parts of the launching device and flying object will be readily apparent to those skilled in the art, and it will be appreciated that plastic fabrication will normally predominate. Typically, resins such as ABS copolymer, acetal copolymer, polyethlene and PVC will be utilized.

Thus, it can be seen that the present invention provides a novel device for launching a flying object by which the operator can control the time of release, and a novel toy which includes such a device. Release of the flying object is effected by the actuating means for the spinning mechanism, and the toy may be in the form of a winged creature figure in which the wings enclose the flying object and automatically open to release it when the operator desires to do so. The toy is effective in its appearance and utility, is durable, and is relatively facile and inexpensive to manufacture.

Having thus described the invention, what is claimed is:

1. A device for launching a flying object, comprising:

a body having a receptacle portion for seating a separate object that is capable of flight when spun;

closure means mounted on said body for movement between a closed position over said receptacle portion and an open position displaced therefrom, said closure means cooperating with said body to provide an enclosure within which the object can spin;

means for releasably engaging said closure means in said closed position thereof;

a mechanism within said body for spinning the object, said mechanism including an element disposed within said receptacle portion adapted to releasably engage the object to impart rotation thereto; and manual actuating means capable of stroking movement to drive said spinning mechanism, said actuating means also being adapted for effecting release of said engaging means at a certain point during the stroke thereof, whereby said actuating means can be used to first impart rotation to such a flying object disposed within said enclosure, and to therefore effect release of said engaging means to displace said closure means and thereby permit the spinning object to fly out of said receptacle portion and away from said device.

2. The device of claim 1 wherein said actuating means comprises a lever pivotably mounted upon said body, said point of release occurring substantially at a limit of the stroke thereof.

3. The device of claim 2 wherein said actuating means has a power stroke in one direction and a recovery stroke in the opposite direction of pivoting, and wherein said spinning mechanism includes means for effectively disconnecting said actuating means from said object-engaging element in said opposite direction to provide said recovery stroke.

4. The device of claim 3 wherein said spinning mechanism comprises a gear train including an idler gear which is mounted for shifting movement into and out of operative engagement, depending upon the direction of force applied to it.

5. The device of claim 2 wherein said closure means comprises a pair of door members pivotably mounted upon said body and having associated means biasing them toward said open position.

6. The device of claim 2 wherein said engaging means comprises a link mounted for shifting movement within said body and operatively connected to said actuating lever, said closure means and link having cooperating means thereon for latching said closure means in said closed position.

7. The device of claim 6 wherein said lever has a path defined therein with a contact surface at one end, and wherein said link has an element extending therefrom into said defined lever path, said link element being disposed to pass freely along said path and to contact said surface at said stroke limit to provide said point of release, contact of said element by said surface causing shifting of said link to disengage said cooperating latching means.

8. The device of claim 5 wherein said door members have interengaging means thereon to enable one of them to hold the other in said closed position, said one door member having a latching element thereon comprising said engaging means.

9. The device of claim 5 wherein said body is of creature-like form, and wherein said door members are formed to simulate wings thereon.

10. The device of claim 2 wherein said body is of creature-like form, and wherein said device additionally includes a plurality of appendages on said body simulating creature legs, one of said leg-simulating appendages comprising said actuating lever.

11. The device of claim 10 wherein two others of said appendages are made of a resiliently deflectable material and have finger-engaging elements thereon, and wherein said device additionally includes a rigid holder attached to said body and adapted to receive two fingers for holding said device, said appendages being positioned with respect to said holder to permit the user to engage and move them with the fingers received by said holder.

12. A flying object toy comprising: an object that is capable of flight when spun, and a device for launching said object, said device including:

a body having a receptacle portion in which said object is rotatably seating;

closure means mounted on said body for movement between a closed position over said receptacle portion and an open position displaced therefrom, said closure means cooperating with said body to provide an enclosure within which said object can spin;

means for releasably engaging said closure means in said closed position thereof;

a mechanism within said body for spinning said object, said mechanism including an element disposed within said receptacle portion and releasably engaging said object to impart rotation thereto; and manual actuating means capable of stroking movement to drive said spinning mechanism, said actuating means also being adapted for effecting release of said engaging means at a certain point during the stroke thereof, whereby said actuating means can be used to first impart rotation to said flying object within said enclosure, and to thereafter effect release of said engaging means to displace said closure means and thereby permit said spinning object to fly out of said receptacle portion and away from said device.

13. The device of claim 12 wherein said closure means comprises a pair of door members pivotably mounted upon said body and having associated means biasing them toward said open position, said door members having interengaging means thereon to enable one of them to hold the other in said closed position, said one door member having a latching element thereon comprising said engaging means.

14. The device of claim 12 wherein said actuating means has a power stroke in one direction and a recovery stroke in the opposite direction of movement, and wherein said spinning mechanism includes means for effectively disconnecting said actuating means from said object-engaging element in said opposite direction to provide said recovery stroke.

15. The toy of claim 12 wherein said object has a recess of non-circular cross section formed into the underside thereof, and wherein said engaging element of said spinning mechanism projects outwardly within said receptacle portion of said body and is also of non-circular cross section for engagement of said object against relative rotation, said object being freely movable on said engaging element in said outwardly direction to permit said object to readily exit from said receptacle portion when said closure means is displaced.

16. A winged creature figure toy comprising: an object in the form of a flying insect that is capable of flight when spun, and a device for launching said object, said device including:

a creature-like body having a receptacle portion in which said object is rotatably seating;

closure means in the form of a pair of wing-simulating members mounted on said body for movement between a closed position over said receptacle portion and an open position displaced therefrom, said closure means having associated means biasing them toward said open position and cooperating with said body when closed to provide an enclosure within which said object can spin;

means for releasably engaging said closure means in said closed position thereof;

a mechanism within said body for spinning said object, said mechanism including an element disposed within said receptacle portion and releasably engaging said object to impart rotation thereto; and manual actuating means in the form of a creature leg capable of stroking movement to drive said spinning mechanism, said actuating means also being adapted for effecting release of said engaging means at a certain point during the stroke thereof, whereby said actuating means can be used to first impart rotation to said flying object within said enclosure, and to thereafter effect release of said engaging means to displace said closure means and thereby permit said spinning object to fly out of said receptacle portion and away from said device.

17. The toy of claim 16 additionally including two leg-simulating appendages made of a resiliently deflectable material and having finger-engaging elements thereon to enable facile manual movement thereon, and a rigid holder attached to said body and adapted to receive two fingers for holding said device, said appendages being positioned with respect to said holder to permit the user to hold and engage them with the fingers received by said holder.

* * * * *